US006319175B1

(12) United States Patent
Wu

(10) Patent No.: US 6,319,175 B1
(45) Date of Patent: Nov. 20, 2001

(54) GRIP DEVICE

(76) Inventor: Race Wu, 3F, No. 82, Yi-Ping Rd., Yi-Hsin Village, Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/503,327

(22) Filed: Feb. 14, 2000

(30) Foreign Application Priority Data

Dec. 29, 1999 (TW) ..... 88222326

(51) Int. Cl.[7] ..... A63B 21/055; A63B 23/16
(52) U.S. Cl. ..... 482/49; 482/126
(58) Field of Search ..... 482/44–50, 121, 482/122, 124, 126–128, 907; 601/40

(56) References Cited

U.S. PATENT DOCUMENTS 4,629,186 * 12/1986 Aldridge ..... 482/126
4,726,580 * 2/1988 Batiste et al. ..... 482/49
5,267,929 * 12/1993 Chen ..... 482/128
5,409,436 * 4/1995 Chang ..... 482/49

FOREIGN PATENT DOCUMENTS

380231 * 9/1923 (DE) ..... 482/50
446167 * 9/1912 (FR) ..... 482/50
16256 * 10/1912 (FR) ..... 482/50
1344828 * 1/1974 (GB) ..... 482/128
167484 * 1/1922 (GB) ..... 482/47

* cited by examiner

*Primary Examiner*—Mickey Yu
*Assistant Examiner*—Victor K. Hwang
(74) *Attorney, Agent, or Firm*—Browdy and Neimark

(57) ABSTRACT

An adjustable grip device comprises two handles, two links, a restraining member, and an elastic member. The handles are pivoted together such that the handles are capable of moving inward or outward in a predetermined range. The links are pivoted at one end thereof with the midsegment of the handles and are pivoted with each other at other end thereof by a middle pivot. The restraining member is disposed on the pivoting end of the handles. The elastic member is connected at one end thereof with the middle pivot, and at other end thereof with the restraining member. The restraining member is capable of restraining various portions of the elastic member. The restrained portion of the elastic member is incapable of deforming.

17 Claims, 8 Drawing Sheets

GRIP DEVICE

FIELD OF THE INVENTION

The present invention relates generally to a grip device, and more particularly to an adjustable grip device.

BACKGROUND OF THE INVENTION

The U.S. Pat. No. 5,409,436 discloses an adjustable grip device comprising a pressure block compressing one end of a compression spring, so as to control the pressure range of the compression spring. As a result, the resistance of the grip device is adjusted. When the adjustment is made to have a greater resistance, the spring is under the pressure of the pressure block for a prolonged period of time, thereby resulting in the fatigue of the spring. The efficiency of the grip device is thus reduced.

The distance between the two handles of the conventional grip device is too great for the palm of a woman or child. A normal man will feel uncomfortable if the distance between the handles is smaller.

SUMMARY OF THE INVENTION

The primary objective of the present invention is to provide an adjustable grip device with a different mode of adjustment to reduce the probability of the spring fatigue.

It is another objective of the present invention to provide an adjustable grip device with two adjustable handles which can be adjusted in distance between them.

The present invention comprises two handles, two links, a restraining member, and an elastic member. The two handles are pivoted together such that they can be opened and closed. The two links are fastened pivotally at one end thereof with the midsegment of the handles, and at other end thereof with each other by a middle pivot. The restraining member is disposed on the pivoting ends of the handles. The elastic member is connected at one end thereof with the middle pivot such that other end thereof is disposed on the restraining member. The restraining member restrains the elastic member on different positions of the elastic member such that the restrained portion of the elastic member does not deform.

In light of the principle of the mechanics of materials, two elastic bodies, with same material and shape, their lengths bring about the recovering forces which are in inverse proportion under the condition of the same deformation quantity. The portion of the elastic member that is not restrained is the range of resistance that is actually brought about by the elastic member. The magnitude of resistance of the adjustable grip device is adjusted by adjusting the restrained position of the elastic member.

In using the adjustable grip device of the present invention, the open angle of the two handles can be first adjusted before disposing the elastic member on the restraining member, so as to adjust the distance between the two handles.

DETAILED DESCRIPTION OF THE INVENTION

Figure 1:
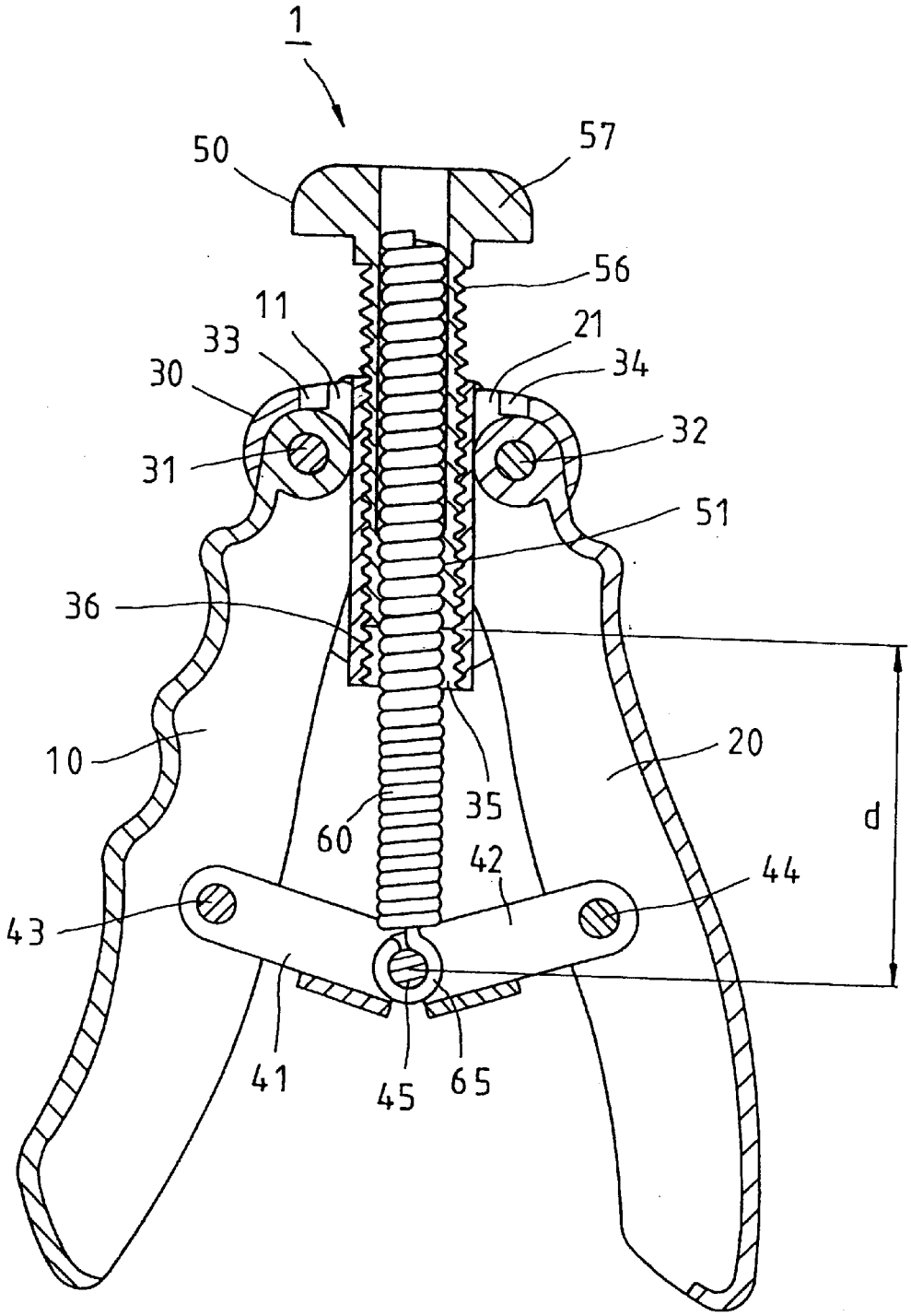
FIG. 1 shows a front sectional view of a first preferred embodiment of the present invention.
Figure 2:
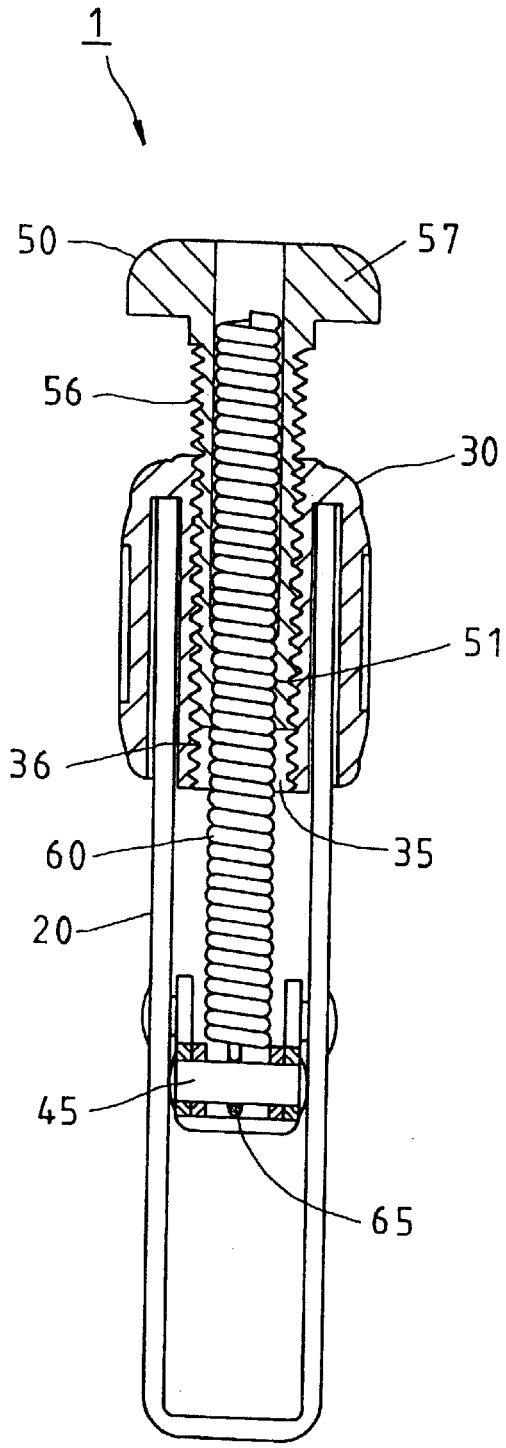
FIG. 2 shows a side sectional view of the first preferred embodiment of the present invention.
Figure 3:
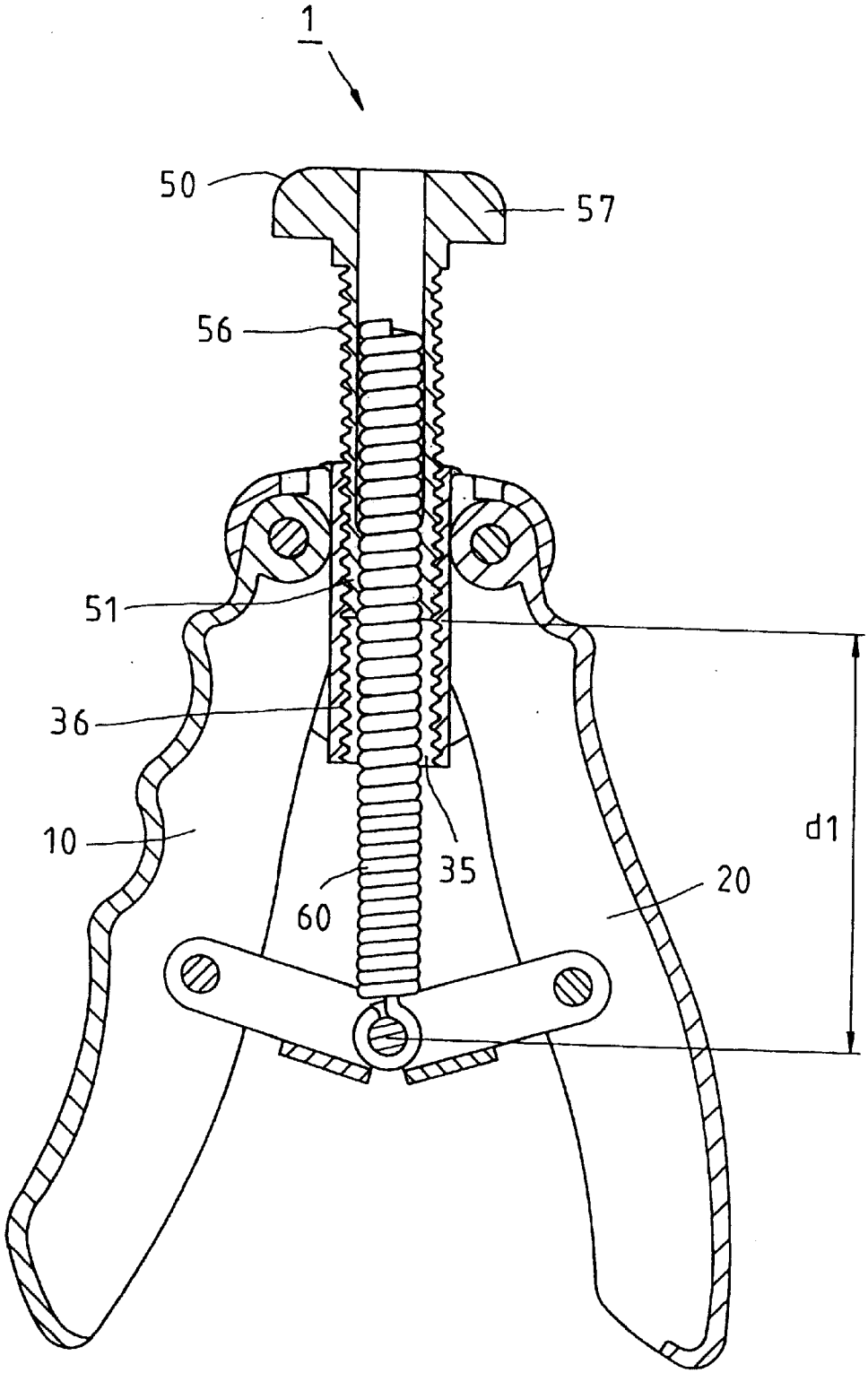
FIG. 3 shows a schematic view of the first preferred embodiment of the present invention which is adjusted to have a smaller resistance.

As shown in FIGS. 1 and 2, an adjustable grip device 1 embodied in the present invention comprises two handles 10 and 20, which are provided with a pivoting end. These two pivoting ends are pivoted together to enable the two handles 10 and 20 to move away from or toward each other within a predetermined range.

The adjustable grip device 1 further comprises a connection member 30 which is pivoted with two pivots 31 and 32 of the pivoting ends of the two handles 10 and 20. The connection member 30 is provided in two sides of the end wall thereof with two confining slots 33 and 34. The pivoting ends of the handles 10 and 20 are provided with protrusions 11 and 21, which are corresponding to the two confining slots 33 and 34 and are received respectively in the confining slots 33 and 34. When the two handles 10 and 20 form therebetween a predetermined angle, the protrusions 11 and 21 are in contact with the peripheral edges of the confining slots 33 and 34, so as to confine the open range or the close range of the two handles 10 and 20.

Two links 41 and 42 are pivoted at one end thereof with the midsegment of the two handles 10 and 20 by a pivot 43, 44, such that other ends of the links 41 and 42 are pivoted by a middle pivot 45. The two links 41 and 42 form a V-shaped construction, with the tip end facing the open end of the handles 10 and 20.

A restraining member 50 is disposed on the connection member 30 and is of a tubular construction. The restraining member 50 is provided in the inner wall thereof with a spiral receiving slot 51, and in the outer wall thereof with an outer thread 56. The connection member 30 is provided with a through hole 35 which is provided in the wall thereof with an inner thread 36 corresponding to the outer thread 56. One end of the restraining member 50 is engaged with the through hole 35 of the connection member 30. The exposed end of the restraining member 50 has a rotary portion 57 to be gripped by fingers.

An elastic member 60 is connected at one end thereof with the middle pivot 45 such that other end thereof is disposed on the restraining member 50 capable of restraining the elastic member 60 on various positions of the elastic member 60. The restrained portion of the elastic member 60 is immune from deformation. The elastic member 60 is a spiral spring, which is provided at one end thereof with a curved hook 65 engaging the middle pivot 45. The other end of the elastic member 60 is received in the receiving slot 51 of the restraining member 50.

As shown in FIG. 1, the portion of the elastic member 60 is restrained by the receiving slot 51 and is immune from deformation. The elastic member 60 can be expanded such that a portion (d) is exposed in the outside of the restraining member 50. When two handles 10 and 20 are pressed to cause the middle pivot 45 to displace downward such that the portion (d) is pulled to form resistance of the present invention. When the handles 10 and 20 are relieved of the pressure, the handles 10 and 20 will return to their original positions by the recovering force of the elastic member 60. The action is carried out repeatedly.

Figure 4:
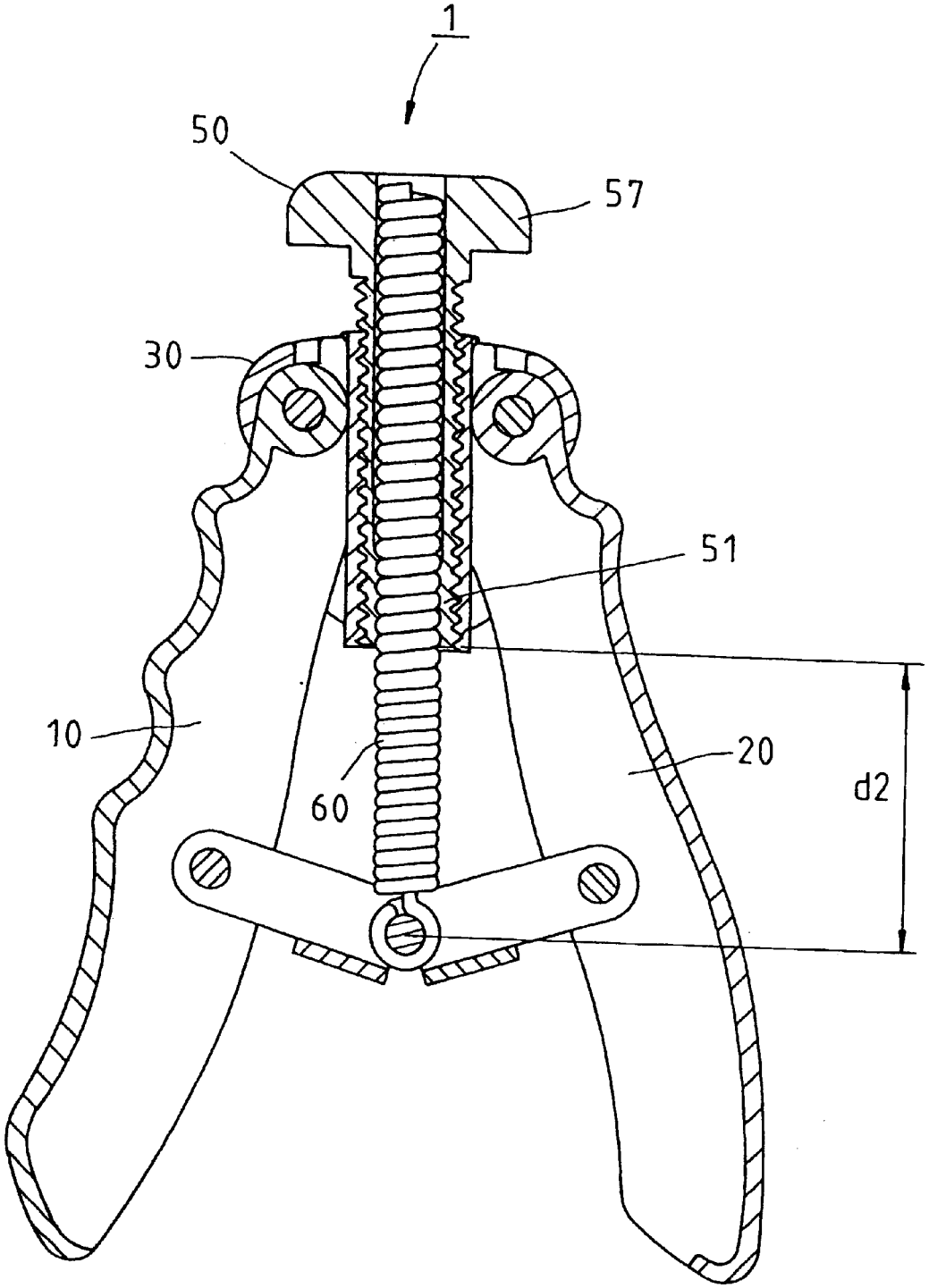
FIG. 4 shows a schematic view of the first preferred embodiment of the present invention which is adjusted to have a greater resistance.
Figure 5:
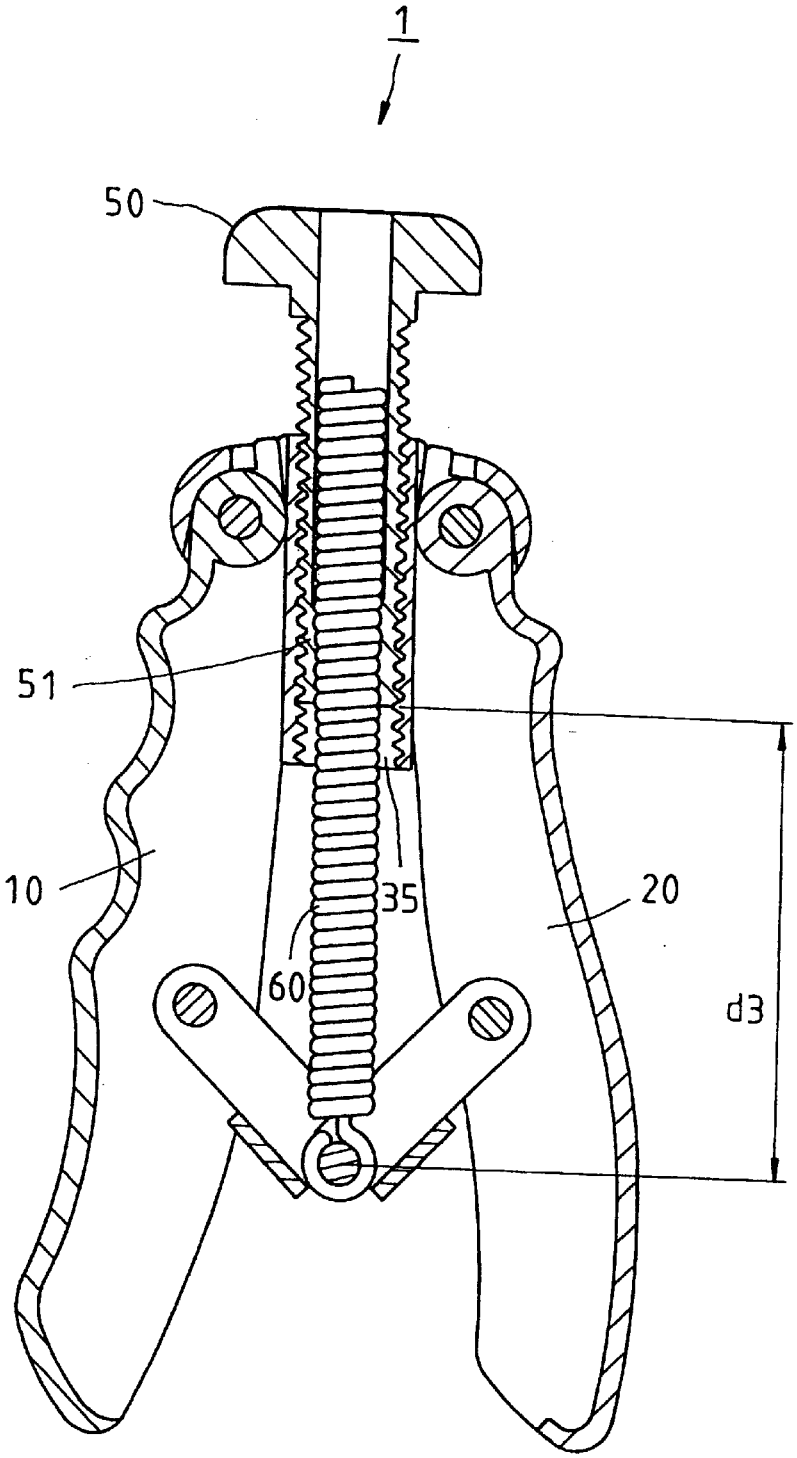
FIG. 5 shows a schematic view of the first preferred embodiment of the present invention whose handles are separated from each other by a smaller distance.

As shown in FIG. 4, the rotary portion 57 is turned counterclockwise to cause the restraining member 50 to displace outward in relation to the connection member 30. Because of the inner thread 36, the outer thread 56, the receiving slot 51, and the elastic member 60 have the same thread direction and pitch, thereby preventing the elastic member 60 from being actuated by the restraining member 50 in motion. As a result, the position of the elastic member 60 in the receiving slot 51 is changed. The exposed portion of the elastic member 60 has an expandable length (d1), which is increased to provide the present invention with a smaller resistance. On the other hand, as shown in FIG. 5, the rotary portion 57 is turned clockwise, the restraining member 50 displaces inward in relation to the connection member 30. The expandable length (d2) of the elastic member 60 is decreased to provide the present invention with a greater resistance.

In the process of adjusting the distance between the two handles 10 and 20, the restraining member 50 is first dismantled. The two handles 10 and 20 are then arranged to form an angle before the restraining member 50 is engaged with the through hole 35 of the connection member 30. In the meantime, the elastic member 60 is disposed in the receiving slot 51. Now referring to FIG. 6, the angle between the two handles 10 and 20 is smaller such that the expandable length (d3) of the elastic member 60 becomes greater. That will provide the present invention with smaller resistance to facilitate the use of device by a person having a smaller palm. On the contrary, as the angle between the two handles 10 and 20 becomes greater, the expandable length of the elastic member becomes smaller to provide the present invention with a greater resistance to facilitate the use of device by a person having a bigger palm.

Figure 6:
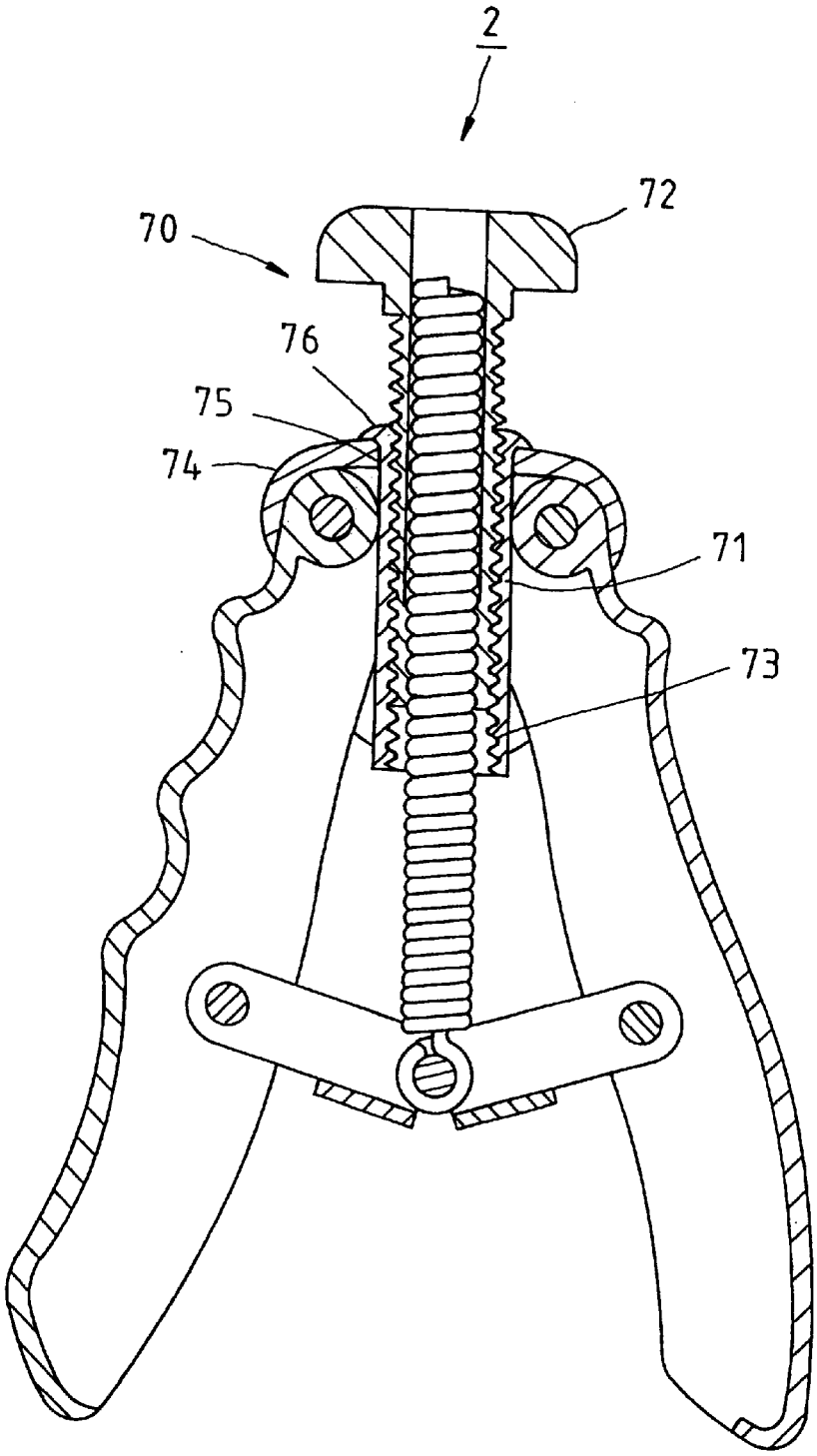
FIG. 6 shows a front sectional view of a second preferred embodiment of the present invention.

As shown in FIG. 6, a grip device 2 of the second preferred embodiment of the present invention is basically similar in construction to the first preferred embodiment except that the former has a restraining member 70 which comprises an adjustment seat 71 and an adjustment member 72. The adjustment seat 71 is of a tubular construction and is provided in the internal wall thereof with an inner thread 73. The adjustment member 72 is similar in construction to the restraining member 50 of the first preferred embodiment and is engaged at one end thereof with the adjustment seat 71. The through hole 75 of the connection member 74 is not threaded. One end of the adjustment seat 71 is inserted into the through hole 75. The exposed end of the adjustment seat 71 is provided with a stop surface 76 in contact with the end wall of the connection member 74.

Figure 7:
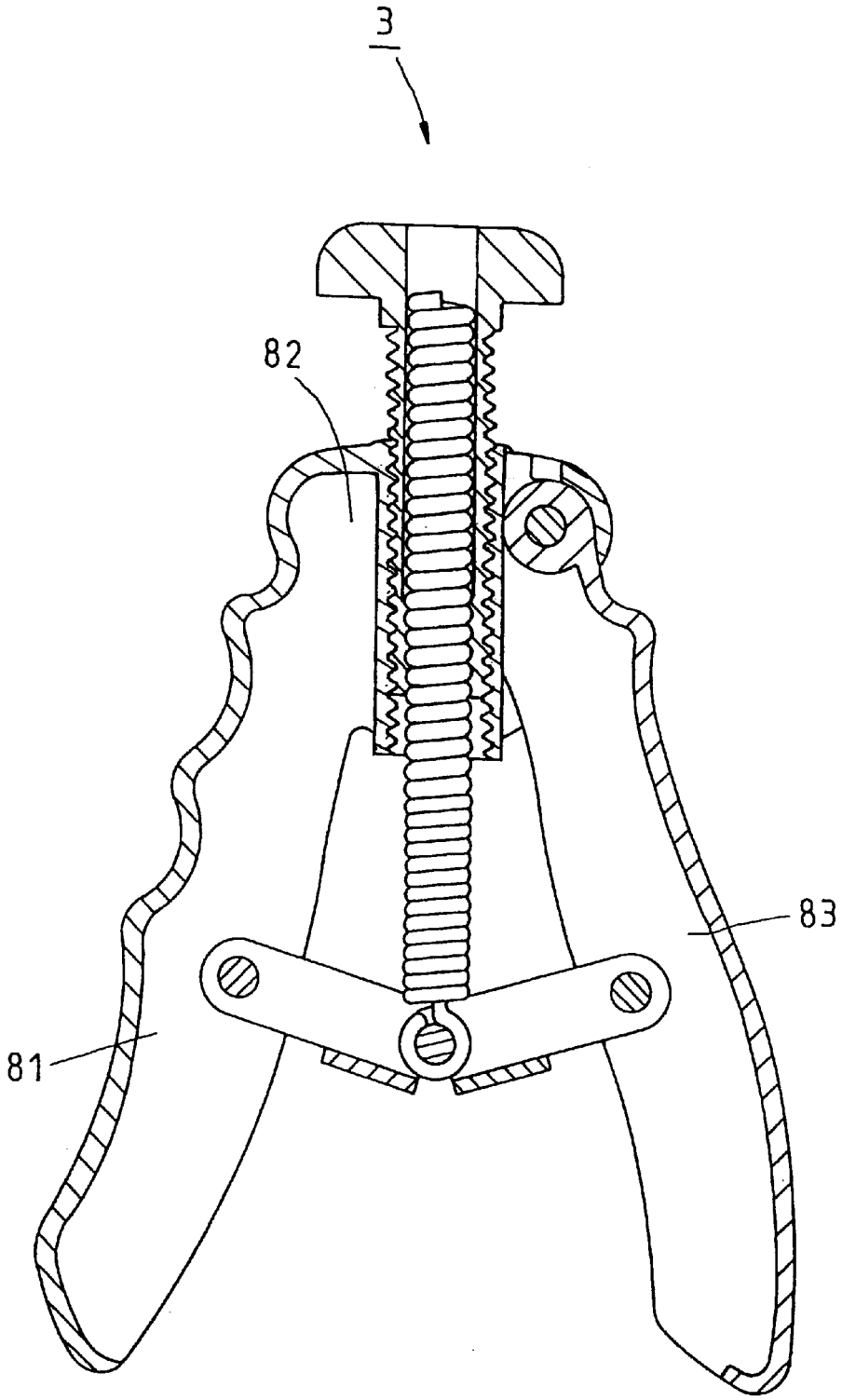
FIG. 7 shows a front sectional view of a third preferred embodiment of the present invention.

As shown in FIG. 7, an adjustable grip device 3 of the third preferred embodiment of the present invention is basically similar in construction to that of the first preferred embodiment, with the difference being that the device 3 has one handle 81 which is provided at one end thereof with a head 82, and other handle 83 which is pivoted with the head 82.

Figure 8:
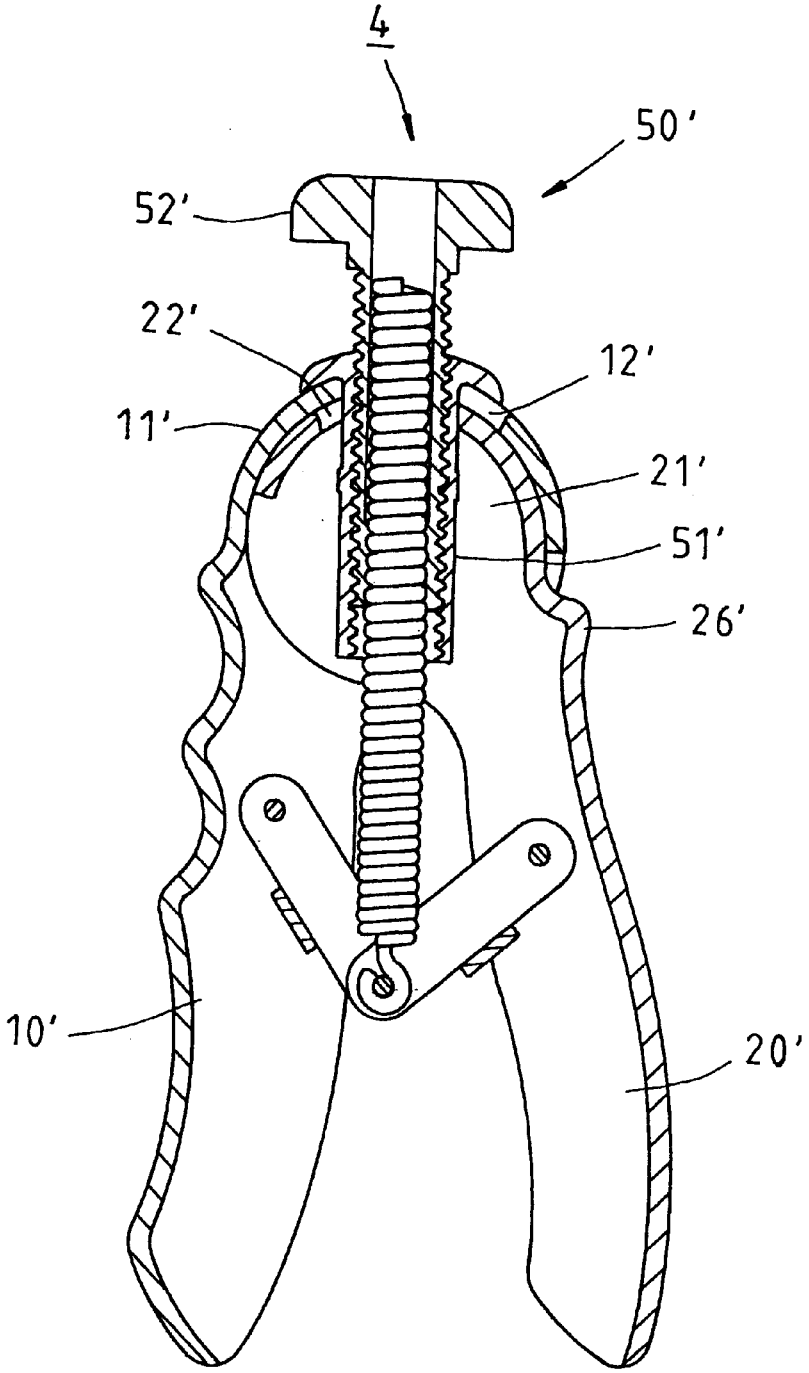
FIG. 8 shows a front sectional view of a fourth preferred embodiment of the present invention.

As shown in FIG. 8, an adjustable grip device 4 of the fourth preferred embodiment of the present invention is basically similar in construction to the preferred embodiments described above, except that the device 4 has two handles 10' and 20', which are provided at one end thereof with two lugs 11', 21'. Located in the wall between the two lugs 11' and 21' is an arcuate slot 12', 22'. The lugs 11' and 21' are fastened pivotally by a pivot (not shown in the drawing) serving as a fulcrum on which the handles 10' and 20' turn. The restraining member 50' is similar in construction to the restraining member 70 of the second preferred embodiment and is formed of an adjustment seat 51' and an adjustment member 52'. The adjustment seat 51' is disposed between the lugs 11' and 21' via the two arcuate slots 12' and 22', which are similar in function to the confining slots 33 and 34. When the two handles 10' and 20' are moved in the same direction or in the opposite directions to form therebetween a predetermined angle, the peripheral edges of the two arcuate slots 12' and 22' come in contact with the sides of the adjustment seat 51', so as to confine the range in which the two handles 10' and 20' swivel. The handle 20' is provided in the outer side thereof with a shoulder 26' which comes in contact with the wall of the handle 10' at such time when the two handles 10' and 20' are moved in the opposite directions to form therebetween a predetermined angle. As a result, the moving range of the handles 10' and 20' is confined.

What is claimed is:

1. An adjustable grip device comprising:

two handles fastened pivotally with each other such that enable said two handles to move inward or outward in a predetermined range;

two links pivoted at one end thereof to a midsegment of said two handles such that said two links are fastened pivotally with each other at other end thereof by a middle pivot;

a restraining member disposed at a pivoting end of said two handles; and an elastic member connected at one end thereof with said middle pivot, and at other end thereof is disposed on said restraining member whereby said restraining member restrains said elastic member on various position of said elastic member such that a restrained portion of said elastic member is prevented from being deformed.

2. The adjustable grip device as defined in claim 1, wherein said pivoting end of said two handles is provided with two lugs whereby said two lugs are fastened pivotally with each other by a pivot; and wherein said handles are provided with an arcuate slot located between said two lugs.

3. The adjustable grip device as defined in claim 2, wherein said restraining member comprises an adjustment seat and an adjustment member, with said adjustment seat being of a tubular construction and provided in an inner wall thereof with an inner thread, said adjustment member being of a tubular construction and provided in an inner wall thereof with a receiving slot and in an outer wall thereof with an outer thread corresponding to said inner thread of said adjustment seat; said adjustment seat is disposed between said two lugs via said two arcuate slots of said two handles and said adjustment member is engaged with said adjustment seat; wherein said elastic member is a spiral spring which is provided at one end thereof with a curved hook engaging said middle pivot, with other end of said spiral spring being received in said receiving slot of said adjustment member.

4. The adjustable grip device as defined in claim 3, wherein said adjustment seat is provided in an exposed end thereof with a stop surface in contact with one of said two handles.

5. The adjustable grip device as defined in claim 3, wherein said adjustment member is provided in an exposed end thereof with a rotary portion.

6. The adjustable grip device as defined in claim 1, wherein said pivoting end of one of said two handles has a head whereby said head is pivoted with other one of said two handles.

7. The adjustable grip device as defined in claim 6, wherein said restraining member is of a tubular construction and is provided in an inner wall thereof with a receiving slot and in an outer wall thereof with an outer thread; wherein said head is provided with a through hold which is provided with an inner thread corresponding to said outer thread of said restraining member, said restraining member being engaged with said through hole of said head; wherein said elastic member is a spiral spring which is provided at one end thereof with a curved hook, said spiral spring having other end which is receiving in said receiving slot.

8. The adjustable grip device as defined in claim 7, wherein said restraining member has an exposed end which is provided with a rotary portion.

9. The adjustable grip device as defined in claim 6, wherein said restraining member comprises an adjustment seat and an adjustment member, with said adjustment seat being of a tubular construction and provided in an inner wall thereof with an inner thread, said adjustment member being of a tubular construction and provided in an inner wall thereof with a receiving slot and in an outer wall thereof with an outer thread corresponding to said inner thread of said adjustment seat; wherein said head is provided with a through hole in which said adjustment seat is disposed and said adjustment member is engaged with said adjustment seat; wherein said elastic member is a spiral spring which is provided at one end thereof with a curved hook engaging said middle pivot, with other end of said spiral spring being received in said receiving slot of said adjustment member.

10. The adjustable grip device as defined in claim 9, wherein said adjustment seat is provided at an exposed end thereof with a stop surface in contact with said head.

11. The adjustable grip device as defined in claim 9, wherein said restraining member is provided at an exposed end thereof with a rotary portion.

12. The adjustable grip device as defined in claim 1 further comprising a connection member fastened pivotally with said pivoting end of said two handles.

13. The adjustable grip device as defined in claim 12, wherein said restraining member is of a tubular construction and is provided in an inner wall thereof with a receiving slot and in an outer wall thereof with an outer thread; wherein said connection member is provided with a through hole which is provided with an inner thread corresponding to said outer thread of said restraining member, said restraining member being engaged with said through hole of said connection member; wherein said elastic member is a spiral spring which is provided at one end thereof with a curved hook, said spiral spring having other end which is receiving in said receiving slot.

14. The adjustable grip device as defined in claim 13, wherein said restraining member is provided at an exposed end thereof with a rotary portion.

15. The adjustable grip device as defined in claim 12, wherein said restraining member comprises an adjustment seat and an adjustment member, with said adjustment seat being of a tubular construction and provided in an inner wall thereof with an inner thread, said adjustment member being of a tubular construction and provided in an inner wall thereof with a receiving slot and in an outer wall thereof with an outer thread corresponding to said inner thread of said adjustment seat; wherein said connection member is provided with a through hole in which said adjustment seat is disposed and said adjustment member is engaged with said adjustment seat; wherein said elastic member is a spiral spring which is provided at one end thereof with a curved hook engaging said middle pivot, with other end of said spiral spring being received in said receiving slot of said adjustment member.

16. The adjustable grip device as defined in claim 15, wherein said adjustment seat is provided at an exposed end thereof with a stop surface in contact with said connection member.

17. The adjustable grip device as defined in claim 15, wherein said restraining member is provided at an exposed end thereof with a rotary portion.

* * * * *